US006751984B2

(12) United States Patent
Neeraas et al.

(10) Patent No.: US 6,751,984 B2
(45) Date of Patent: Jun. 22, 2004

(54) METHOD AND DEVICE FOR SMALL SCALE LIQUEFACTION OF A PRODUCT GAS

(75) Inventors: Bengt Olav Neeraas, Hundhammeren (NO); Einar Brendeng, Trondheim (NO)

(73) Assignee: Sinvent AS, Trondheim (NO)

( * ) Notice: Subject to any disclaimer, the term of this patent is extended or adjusted under 35 U.S.C. 154(b) by 0 days.

(21) Appl. No.: 10/169,068

(22) PCT Filed: Feb. 9, 2001

(86) PCT No.: PCT/NO01/00048

§ 371 (c)(1),
(2), (4) Date: Jul. 25, 2002

(87) PCT Pub. No.: WO01/59377

PCT Pub. Date: Aug. 16, 2001

(65) Prior Publication Data

US 2003/0019240 A1 Jan. 30, 2003

(30) Foreign Application Priority Data

Feb. 10, 2000 (NO) ..... 000660

(51) Int. Cl.[7] ..... F25J 1/00
(52) U.S. Cl. ..... 62/612
(58) Field of Search ..... 62/612

(56) References Cited

U.S. PATENT DOCUMENTS

| | | | | |
|---|---|---|---|---|
| 3,364,685 A | | 1/1968 | Perret | |
| 3,702,063 A | * | 11/1972 | Etzbach et al. | 62/612 |
| 4,141,707 A | | 2/1979 | Springmann | |
| 4,251,247 A | * | 2/1981 | Gauberthier et al. | 62/612 |
| 4,303,427 A | | 12/1981 | Kreiger | |

FOREIGN PATENT DOCUMENTS

| | | |
|---|---|---|
| EP | 599443 | 6/1994 |

* cited by examiner

*Primary Examiner*—William C. Doerrler
(74) *Attorney, Agent, or Firm*—Dennison, Schultz, Dougherty & MacDonald

(57) ABSTRACT

Method and process plant for liquefaction of gas, particularly natural gas with multicomponent refrigerant, suited for small and medium sized scale, where the plant solely is based on conventional two-flow plate heat exchangers and conventional oil lubricated compressors. By the arrangement of the heat exchangers and the compressors according to the invention it is avoided that oil from the compressors, that to some extend will follow the flow of refrigerant, may reach the coldest parts of the plant. Any freezing of oil and plugging of conduit etc. is thus avoided.

9 Claims, 6 Drawing Sheets

METHOD AND DEVICE FOR SMALL SCALE LIQUEFACTION OF A PRODUCT GAS

The present invention relates to a method for liquefaction of gas, particularly natural gas, using multicomponent refrigerant.

BACKGROUND OF THE INVENTION

Liquefaction of gas, particularly natural gas, is well known from larger industrial plants, so called "baseload" plants, and from peak shaving plants. Such plants have the property in common that they convert a substantial quantum gas pr time, so they can bear a significant upfront investment. The costs pr gas volume will still be relatively low over time. Multicomponent refrigerants are commonly used for such plants, as this is the most effective way to reach the sufficiently low temperatures.

Kleemenko (10th International Congress of Refrigeration, 1959) describes a process for multicomponent cooling and liquefaction of natural gas, based on use of multiflow heat exchangers.

U.S. Pat. No. 3,593,535 describes a plant for the same purpose, based on three-flow spiral heat exchangers with a an upward flow direction for the condensing fluid and a downward flow direction for the vaporizing fluid.

A similar plant is known from U.S. Pat. No. 3,364,685, in which however the heat exchangers are two-flow heat exchangers over two steps of pressure and with flow directions as mentioned above.

U.S. Pat. No. 2,041,745 describes a plant for liquefaction of natural gas partly based on two-flow heat exchangers, where the most volatile component of the refrigerant is condensed out in an open process. In such an open process it is required that the gas composition is adapted to the purpose. Closed processes are generally more versatile.

There is however, a need for liquefaction of gas, particularly natural gas, many places where it is not possible to enjoy large scale benefits, for instance in connection with local distribution of natural gas, where the plant is to be arranged at a gas pipe, while the liquefied gas is transported by trucks, small ships or the like. For such situations there is a need for smaller and less expensive plants.

Small plants will also be convenient in connection with small gas fields, for example of so called associated gas, or in connection with larger plants where it is desired to avoid flaring of the gas. In the following the term "product gas" is used synonymously with natural gas.

For such plants it is more important with low investment costs than optimal energy optimization. Furthermore a small plant may be factory assembled and transported to the site of use in one or several standard containers.

SUMMARY OF THE INVENTION

It is thus an object of the present invention to provide a method and a process plant for the liquefaction of gas, particularly natural gas, that is adapted for small and medium sized scale liquefaction.

It is furthermore an object to provide a plant for the liquefaction of gas for which the investment costs are modest.

It is thus a derived object to provide a method and a small scale process plant for cooling and liquefaction of gas, particularly natural gas, with a multicomponent refrigerant, where the plant is solely based on conventional two-flow plate heat exchangers and conventional oil lubricated compressors. It is furthermore a derived object to provide a small scale plant for the liquefaction of natural gas, which plant may be transported factory assembled to the site of use.

With the plant according to the invention there is obtained a small scale plant for cooling and liquefaction, where the plant costs is not prohibitive of a cost-effective operation. By the way with which the components of the plant are combined, it is avoided that oil from the compressors, which to some extent will contaminate the refrigerant, follows the flow of refrigerant to the coldest parts of the plant. It is thus avoided that the oil freezes and plugs conduits etc., which is an essential part of the invention.

To obtain this it has been necessary to include equipment for distribution of refrigerant between pairs of heat exchangers in separate rows, where the heat exchangers that cool the product flow is denoted primary heat exchangers and the heat exchangers that cool/heat different components of the multicomponent refrigerant are denoted secondary heat exchangers. The primary and secondary heat exchangers may be of same type and have similar dimensions, but the number of plates will depend upon the flow rate through the heat exchangers.

Use of multicomponent refrigerant is known per se, while achieving the benefits inherent with being able to reach very low temperatures in a simple plant, based on conventional components, is not. With the plant according to the invention is also obtained a natural flow direction in the plant, namely so that evaporating fluid moves upward while condensing fluid moves downward, avoiding that gravity negatively interferes with the process.

DESCRIPTION OF THE PREFERRED EMBODIMENTS

Figure 1:
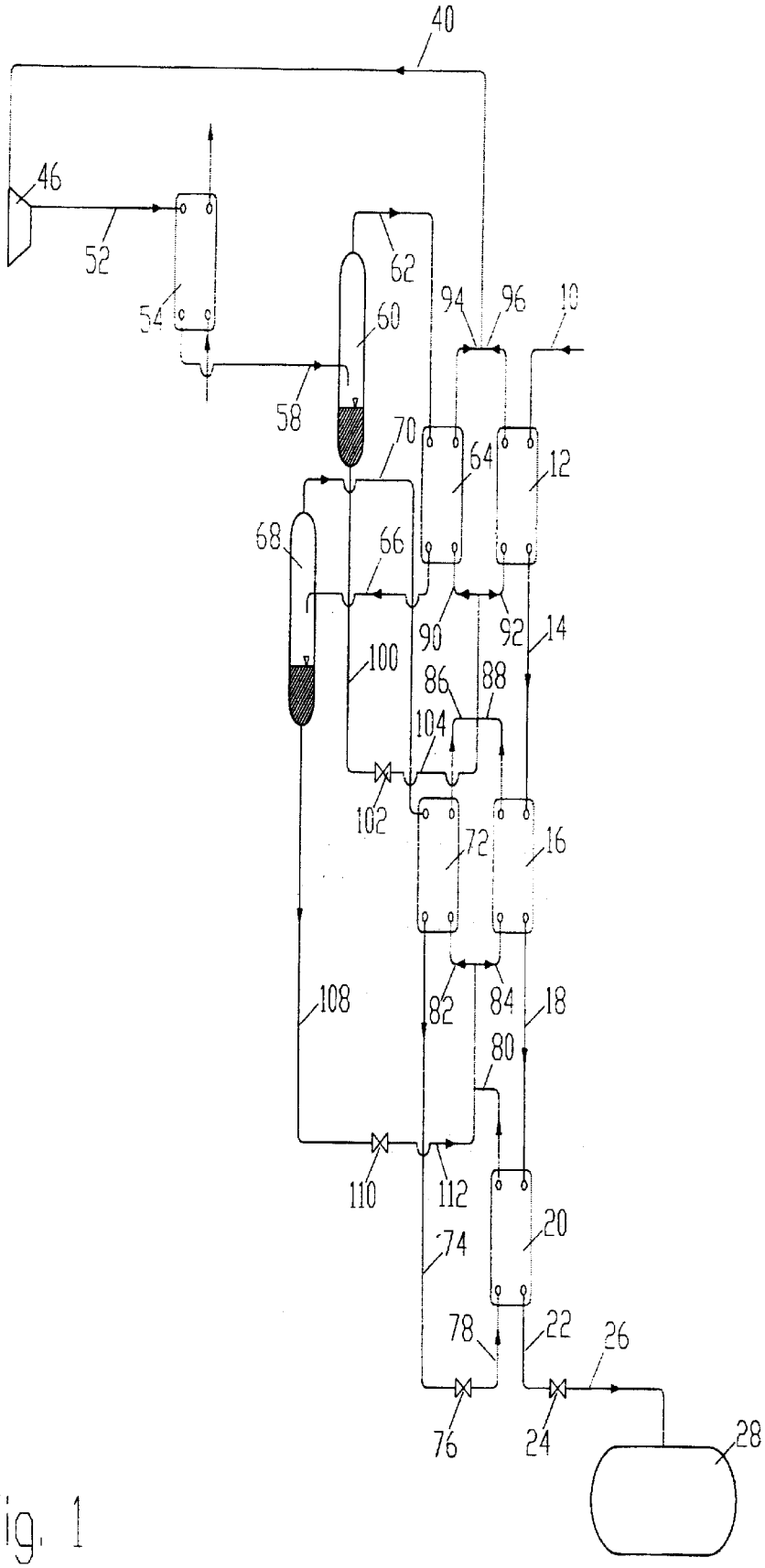
FIG. 1 shows a flow diagram of a process plant according to the invention.

A feed flow of gas, e.g. of natural gas is supplied through conduit 10. This raw material is supplied with a temperature of e.g. approximately 20° C. and with a pressure as high as allowable for the plate heat exchanger in question, e.g. 30 barg. The natural gas has been pre-dried and $CO_2$ has been removed to a level where no solidification (freezing) occurs in the heat exchangers. The natural gas is cooled in the first primary heat exchanger 12 to about −25 to −75° C., typically −30° C., by heat exchanging with low level (low pressure) refrigerant that is supplied to the heat exchanger through conduit 92 and departs from the heat exchanger through conduit 96. The cooled natural gas flows further through conduit 14 to the next primary heat exchanger where it is cooled again, condensed and undercooled to about −85 to −112° C. by heat exchange with low level refrigerant that is supplied to the heat exchanger through conduit 84 and departs from the heat exchanger through conduit 88. If required low volatile components of the natural gas may be separated from the rest of the product flow between heat exchanger 12 and 16, by introducing a phase separator (not shown). From heat exchanger 16 the condensed natural gas flows through conduit 18 to still another heat exchanger 20 where the condensed natural gas is cooled to a temperature low enough to ensure low or no vaporizing in the subsequent throttling to the pressure of the storage tank 28. The temperature may typically be −136° C. at 5 bara or −156° C. at 1.1 bara in the storage tank 28, and the natural gas is led to the tank through throttle valve 24 and conduit 26. The low level refrigerant supplied to heat exchanger 20 through conduit 78 is at its coldest in the process plant, and comprises only the most volatile parts of the refrigerant.

Low level refrigerant in conduit 96 from heat exchanger 12 is joined with low level refrigerant in conduit 94 from heat exchanger 64, where it is used for cooling high level refrigerant, and from this point led through conduit 40 to at least one compressor 46 where the pressure increases to typically 25 barg. The refrigerant then flows through conduit 52 to a heat exchanger 54 where all heat absorbed by the refrigerant from the natural gas in the steps described above, is removed by heat exchange with an available source, like cold water. The refrigerant is thereby cooled to a temperature of typically about 20° C. and partly condensed. From here on the refrigerant flows through conduit 58 to a phase separator 60 where the most volatile components are separated out at the top through conduit 62. This part of the refrigerant constitutes the high level refrigerant to secondary heat exchanger 64 arranged in parallell to primary heat exchanger 12. In heat exchanger 64 the high level refrigerant from conduit 62 is cooled and partly condensed by the low level refrigerant that is supplied to heat exchanger 64 through conduit 90 and departs from the same through conduit 94. From this point the high level refrigerant flows through conduit 66 to a second phase separator 68. Again the most volatile fractions are separated into a high level refrigerant through conduit 70, and supplied to secondary heat exchanger 72 arranged in parallel with primary heat exchanger 16. In heat exchanger 72 the high level refrigerant from conduit 70 is cooled and partly condensed by low level refrigerant that is supplied to heat exchanger 72 through conduit 82 and departs from the same through conduit 86.

From heat exchanger 72 the partly condensed high level refrigerant flows through conduit 74 to a throttle valve 76 for throttling to a lower pressure, and flows from this point as low level refrigerant through conduit 78 to the last heat exchanger 20 where the last step of undercooling of the at this point liquefied natural gas takes place. The refrigerant in conduit 78 is thus at the lowest temperature of the entire process, typically in the range −140° C. to −160° C. In FIG. 1 heat exchanger (20) represents the third step of cooling of the product gas.

Figure 2:
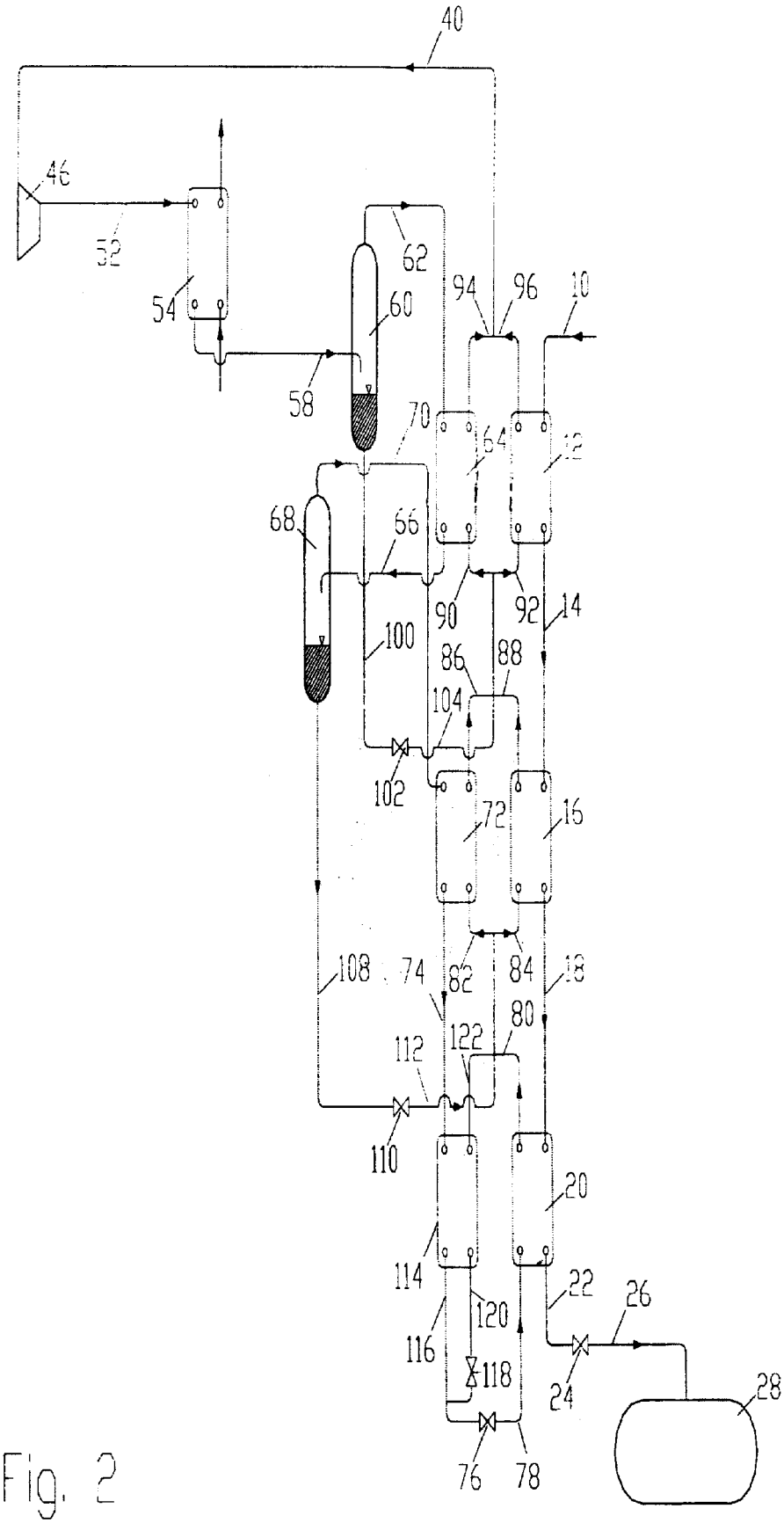
FIG. 2 shows an alternative embodiment of the plant of FIG. 1.

Alternatively the partly condensed high level refrigerant in conduit 74 may be directed to an additional heat exchanger 114, cf. FIG. 2, where high level refrigerant from 74 is undercooled by low level refrigerant supplied to heat exchanger 114 through conduit 120 subsequent to having been throttled to low pressure through a throttle valve 118.

From the first phase separator 60 the less volatile part of the refrigerant flows through conduit 100, is throttled to a lower pressure through valve 102, is mixed with flows of low level refrigerant from conduits 86 and 88 leaving heat exchangers 72 and 16 respectively, whereafter the joined flow of low level refrigerant flows on to heat exchangers 12 and 64 and is distributed between these in a way to be further described below with reference to FIGS. 3–5. Together with the less volatile fraction of the refrigerant in conduit 100 there will always be some contaminations in the form of oil when ordinary oil cooled compressors are used. It is thus an important feature with the present invention at this first, non-volatile flow 100 of refrigerant from the first phase separator 60 only is used for heat exchange in the pair of heat exchangers 12/64 that is least cold, as heat exchanger constitutes the first cooling step of the product gas.

From the second phase separator 68 the low volatile part of the refrigerant flows through conduit 108, is throttled to lower pressure through valve 110, is mixed with low level refrigerant 80 from heat exchanger 20 and thereafter supplied to heat exchangers 16 and 72, between which the refrigerant is distributed in a way that is further described below with reference to FIGS. 3–6.

The low level refrigerant flowing upwards through the pairs of heat exchangers arranged in parallel, denoted primary heat exchangers for cooling of the product gas and secondary heat exchangers for cooling of high level refrigerant, will be heated and partly evaporated by the heat received from the natural gas and from the high level refrigerant. The flow of low level refrigerant is for each pair of heat exchangers 16/72 and 12/64 respectively split in to partial flows which are thereafter joined again. It is convenient that the two flows of low level refrigerant leaving any pair of heat exchangers have equal temperature, i.e. that the temperature of low level refrigerant in conduit 86 is approximately the same as the temperature of low level refrigerant in conduit 88. There is a corresponding situation for the temperature in conduits 94 and 96. In order to obtain this situation, there is arranged a distribution device at the inlet side of each pair of heat exchangers.

Figure 3:
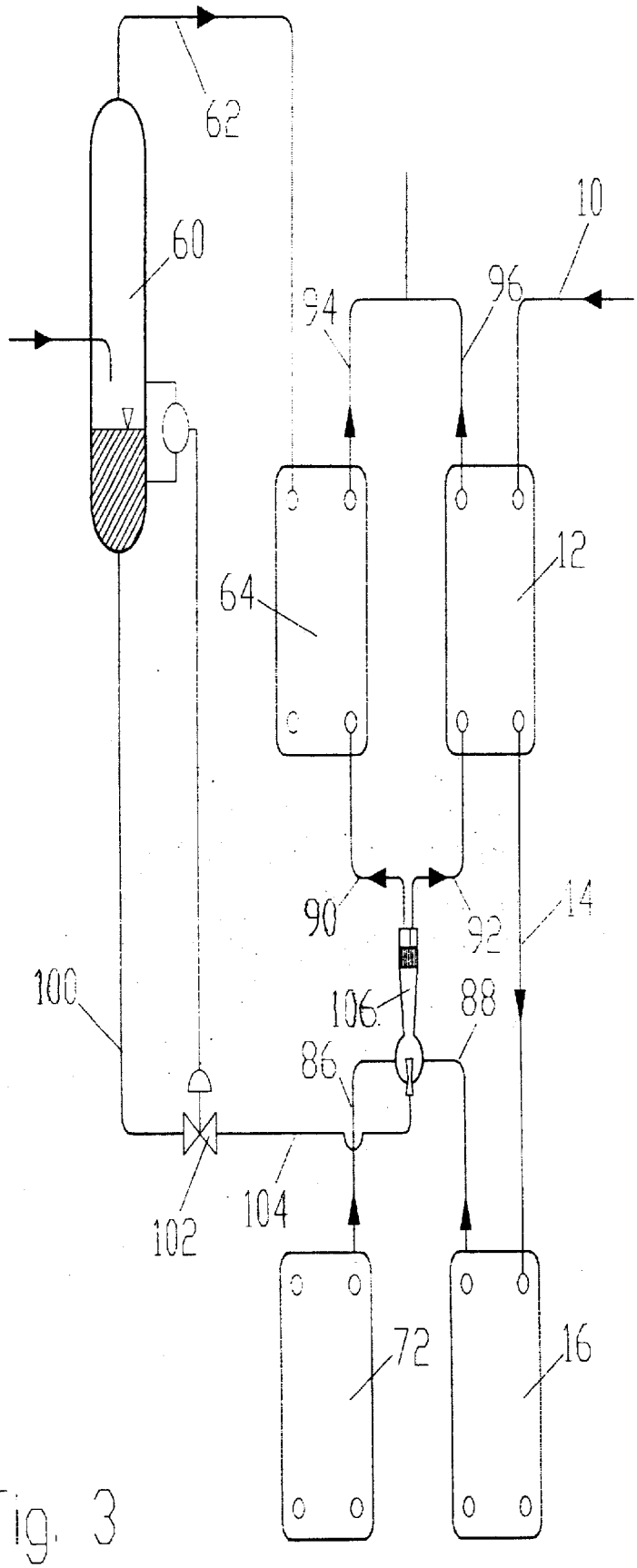
FIG. 3 shows a section of the plant of FIG. 1, with a preferred embodiment of a distribution device for the refrigerant.
Figure 4:
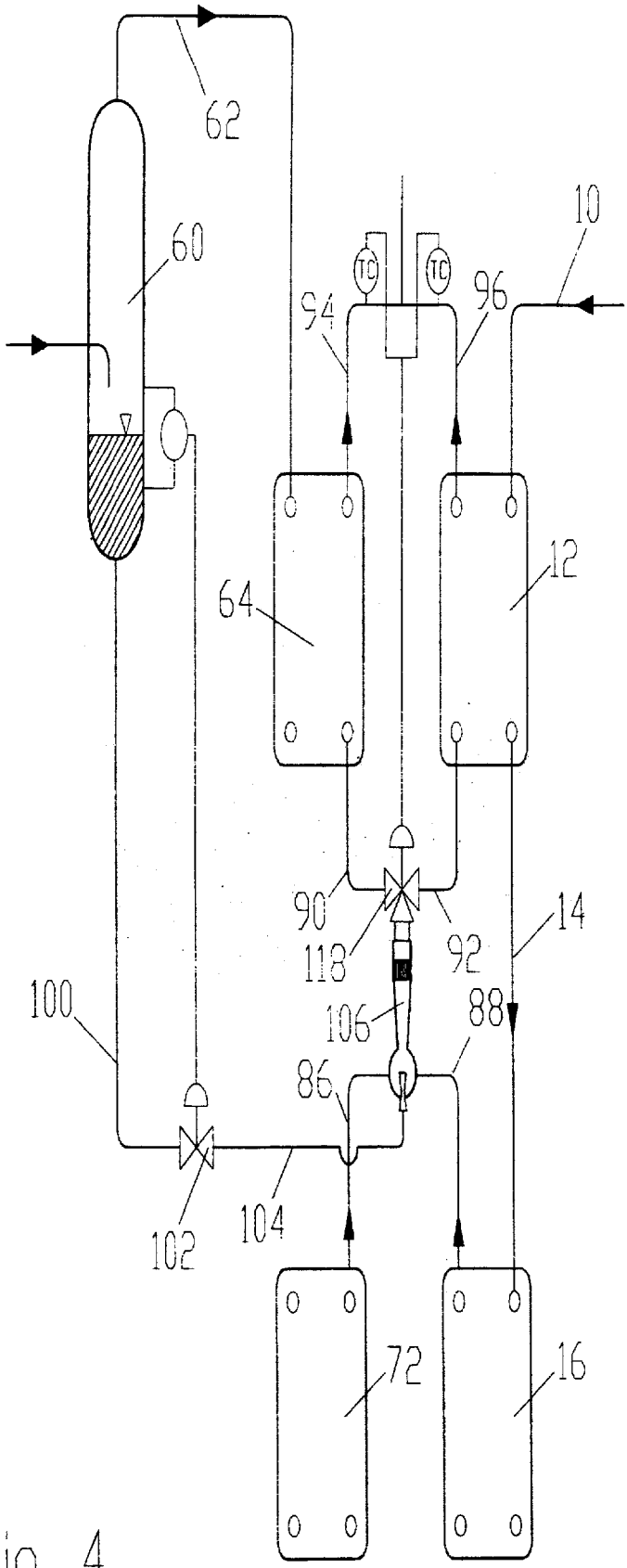
FIG. 4 shows the same section as FIG. 3, with a different embodiment of the distribution device for the refrigerant.

FIG. 3 shows a section of the plant of FIG. 1, comprising a first phase separator 60, two pairs of primary and secondary heat exchangers 12/64 (also called first cooling step) and 16/72 (also called second cooling step), as well as the conduits connecting these components. In addition FIG. 3 furthermore shows a jector shaped distribution device 106 receiving the flows of refrigerant from conduits 86, 88 and 104, cf. FIG. 1, in which the velocity energy from the pressure reduction from a high to a low pressure level in conduit 104 is used to overcome the pressure loss in a mixer for fine dispersion of the liquid in the two-phase flow. On its downstream side the distribution device 106 splits the flow and distributes it between the two conduits 90 and 92 leading to the primary 12 and the secondary 64 heat exchanger constituting the next pair of heat exchangers, in a ratio conveniently determined by a correct area-ratio in the distributing device. FIG. 4 shows an alternative way for controlling the distribution of refrigerant between conduits 90 and 92. On the downstream side of heat exchangers 12 and 64, and more precisely on the conduits 96 and 94 respectively, there are arranged temperature controllers (TC) so that the temperature may be registered. This way it is possible, continuously or periodically to adjust the inertia valve 118 so that the temperatures within the conduits 94 and 96 become as equal as possible, since this is the most rational way to operate the plant. The adjustment of the distributor 106 may be performed manually, though it is preferred that it is performed automatically by means of a processor controlled circuit.

A corresponding arrangement (not shown) for distribution/controlling is preferably arranged also to the inlet side of the heat exchangers 16 and 72, with a temperature control of conduits 86 and 88.

FIGS. 3–6 also show controlling means interconnected between the phase separator 60 and the throttle valve 102, which is continuously controlled in a way that ensures that the level of condensed phase in the phase separator is maintained between a maximum and a minimum level.

Figure 5:
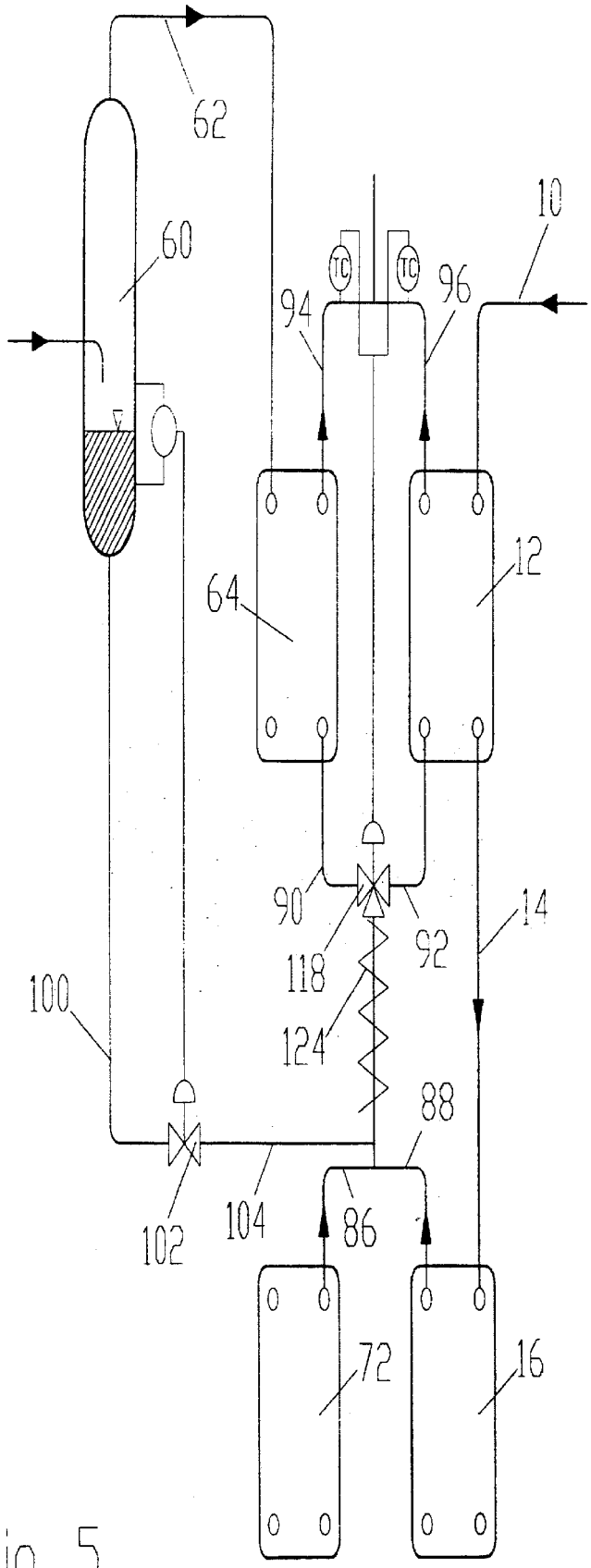
FIG. 5 shows the same section as FIGS. 3 and 4, with a still different embodiment of the distribution device for the refrigerant.

FIG. 5 shows an alternative way of controlling the distribution of the refrigerant between conduits 90 and 92, by which only one inertia valve 118 is used, and the degree of opening of this valve is controlled by the temperature controllers TC. In this case it is convenient to use a mixing device 124 of suitable type, schematically indicated with a zig-zag line.

Figure 6:
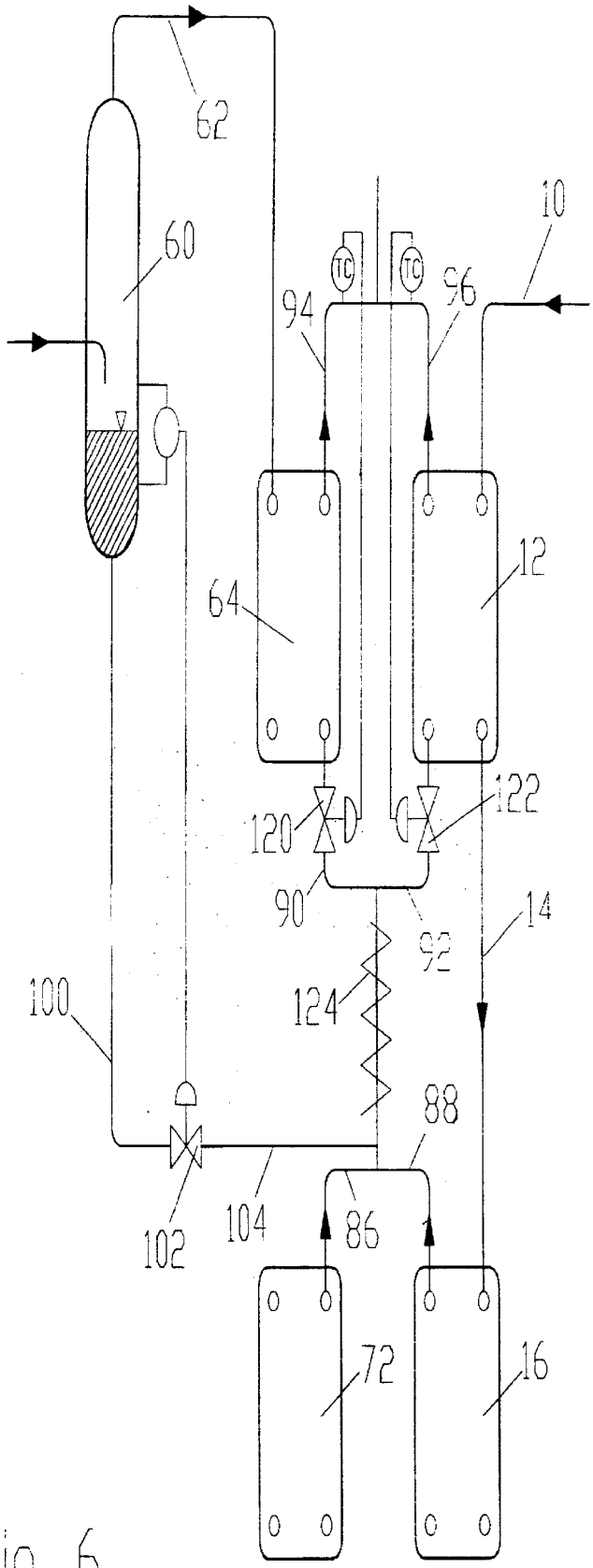
FIG. 6 shows the same section as FIGS. 3, 4 and 5, with a still different embodiment of the distribution device for the refrigerant.

FIG. 6 shows a still further embodiment of the distribution device. The principle is generally the same, but a mechanically different solution is applied, as the device comprises two separate valves 120, 122 connected to each of the conduits 90, 92, the degree of opening again being controlled by the temperature controllers TC.

For the liquefaction of natural gas it is preferred that the plant has two phase-separators 60 and 68 as shown in FIG. 1, and as a consequence of this a three step cooling/condensing of the product flow. For other purposes it may be sufficient with one step less, and only one phase separator. The cooling ability will then be somewhat less. It is also possible to use more than three steps, but this is usually not convenient for relatively small plants from economical and operational points of view.

While FIG. 1 only shows one compressor, it is often more convenient to compress the refrigerant in two serial steps, preferably with interconnected cooling. This has to do with the degree of compression obtainable with simple, oil lubricated compressors, and may be adapted in accordance with the relevant need by a skilled professional.

Again with reference to FIG. 1 it may be convenient to include an additional heat exchanger as explained hereinbelow. Since the low level refrigerant in conduit 40 normally will have a temperature lower than that of the high level refrigerant in conduit 58, it may be convenient to heat exchange these against each other (not shown), thus lowering the temperature of said high level refrigerant further prior to its introduction into phase-separator 60 via conduit 58.

By the method and the plant according to the invention it is provided a solution by which gas, like natural gas may be liquefied cost-effectively in small scale, as the processing means utilized are of a very simple kind. The controlling and adaption of the process ensures that oil from the compressors contaminating the product gas can not freeze and plug conduits or heat exchangers, as the oil do not reach the coldest parts of the plant.

The method and the plant as described above, constitutes preferred embodiments, while the invention in its general form only is limited by the enclosed claims.

What is claimed is:

1. Method of cooling and optically liquefying a product gas comprising hydrocarbon-containing gases or nitrogen, comprising the steps of:

directing the product gas to be cooled to counterflow heat exchange with a multicomponent refrigerant through at least two serially connected two-flow plate heat exchangers which are primary heat exchangers, with compressing of the refrigerant in an oil lubricated compressor subsequent to each cooling cycle;

removing heat absorbed by the refrigerant in the cooling by heat exchange, then passing the cooled refrigerant into at least one phase-separator for separating the multicomponent refrigerant into a more volatile fraction which constitutes a high level refrigerant and a less volatile fraction which constitutes a low level refrigerant;

cooling the more volatile fraction in counterflow heat exchange by a low level refrigerant, by passing through at least one two-flow plate heat exchanger, which is a secondary heat exchanger, arranged in parallels with respect to flow of low level refrigerant, with a primary heat exchanger, so that the primary and secondary heat exchangers are arranged in pairs; and throttling the less volatile fraction to become part of a low level refrigerant, and splitting the low level refrigerant into two separate partial flows, with a partial flow provided to a primary heat exchanger of a pair and to a secondary heat exchanger of said pair, to cool and optionally liquefy the product gas in at least two serially arranged primary heat exchangers, and to cool and partially liquefy the high level refrigerant in at least one secondary heat exchanger, wherein the less volatile fraction from a first of the at least one phase separator constitutes a part of the low level refrigerant in a primary and secondary heat exchanger pair working at the highest temperature and is split between the primary and the secondary heat exchanger pair in a predetermined ratio.

2. Method as claimed in claim 1, wherein the low level refrigerant that is split between pairs of primary and secondary heat exchangers is distributed in a ratio between the heat exchangers of each pair such that the temperature of the low level refrigerant leaving the primary heat exchanger in each pair is approximately equal to the temperature of the low level refrigerant leaving the secondary heat exchanger of the same pair.

3. Method as claimed in claim 1, wherein the flow direction of fluid through the heat exchangers is substantially vertical and that the flow of high level refrigerant and product gas for cooling and partial or complete liquefaction is directed substantially downwardly, and the flow of low level refrigerant that is gradually heated and partly evaporated, is directed substantially upwardly.

4. Method as claimed in claim 1, wherein:

a) three primary and two secondary heat exchangers are used, b) two phase separators are used for the refrigerant, the more volatile fraction from the first of said separators constituting the high level refrigerant for the secondary heat exchanger of the first cooling step and the more volatile fraction from the second of said separators constituting the high level refrigerant for the secondary heat exchanger of the second cooling step, and the less volatile fraction from the first of said separators subsequent is throttled to become part of the low level refrigerant to both heat exchangers of the first cooling step, the less volatile fraction from the second of said phase separators is throttled to become part of the low level refrigerant to both heat exchangers of the second cooling step, the high level refrigerant leaving the secondary heat exchanger of the second cooling step is throttled to become low level refrigerant that cools and condenses the product gas in the primary heat exchanger in a third and last cooling step, c) the product gas subsequent to cooling in the three temperature steps and optionally subsequent throttling to a lower pressure, is directed to a tank for storage, and d) two compressors with an interconnected cooler are used for compressing the refrigerant subsequent to each cooling cycle.

5. Process plant for cooling and optionally liquefying a product gas, said plant comprising:

a) a plurality of two flow heat exchangers including at least two primary heat exchangers for heat exchange between product gas and refrigerant, and at least one secondary heat exchanger for heat exchange between components of high level refrigerant and components of low level refrigerant, the primary heat exchangers being arranged in a serial row which is parallel to a serial row comprising said at least one secondary heat exchanger, said primary heat exchangers comprising a heat exchanger working at a lowest temperature which has no secondary heat exchanger in parallel therewith;

b) a distribution device to distribute low level refrigerant between pairs of heat exchangers at a predetermined ratio arranged between each pair of a primary and a secondary heat exchanger;

c) at least one compressor provided to compress low level refrigerant to a higher pressure after exiting from the first of the primary heat exchangers in the series and the secondary heat exchanger in parallel therewith, and a subsequent, tertiary heat exchanger for removing net heat absorbed by the compressed refrigerant;

d) at least one phase separator arranged downstream of the tertiary plate heat exchanger for separating compressed, cooled and partially condensed refrigerant into a vapor phase constituting a high level refrigerant which is provided to the secondary heat exchangers, and a condensed phase; and means for throttling the condensed phase to form a component of a low level refrigerant which is provided to the distribution device.

6. Process plant as claimed in claim 5, wherein the compressor is an oil lubricated compressor.

7. Process plant as claimed in claim 5, wherein the primary, secondary and tertiary heat exchangers are copper-soldered plate heat exchangers.

8. Process plant as claimed in claim 5, wherein the distribution device comprises means for mixing of the refrigerant from the primary and secondary heat exchangers.

9. Process plant as claimed in claim 8, wherein the means for mixing comprises an ejector for utilization of pressure energy of the high level refrigerant for comminuting the fluid of the two-phase flow, and a distributor device for distribution of the refrigerant in a predetermined ratio.

* * * * *